United States Patent [19]

Bentsen

[11] Patent Number: 4,651,504

[45] Date of Patent: Mar. 24, 1987

[54] DOUBLE FUNNEL BAG MATERIAL AND METHOD

[75] Inventor: Per Bentsen, Suffern, N.Y.

[73] Assignee: Minigrip Incorporated, Orangeburg, N.Y.

[21] Appl. No.: 749,815

[22] Filed: Jun. 28, 1985

[51] Int. Cl.[4] ..... B31B 1/90; B65B 9/08

[52] U.S. Cl. ..... 53/452; 53/412; 493/211; 493/214; 493/931

[58] Field of Search ..... 53/452, 412, 456; 156/91, 92, 244.13, 244.24; 222/527–530, 535; 493/213, 214, 215, 211, 339, 920, 923, 927, 929, 931

[56] References Cited

U.S. PATENT DOCUMENTS 3,219,084 11/1965 Ausnit et al. ..... 493/215 X
3,543,379 12/1970 Naito ..... 493/215 X
4,398,903 8/1983 Lehmacher ..... 493/226 X
4,523,918 6/1985 Ausnit ..... 493/215 X

*Primary Examiner*—James F. Coan

[57] ABSTRACT

Double funnel bag material and method, wherein continuous length plastic film material is formed into a plurality of coextensive funnel strips connected together as formed. Each of the funnel strips is provided along an edge which is remote from the edge connection with the companion strip, with a zig-zag edge defining a series of funnel pockets therealong. The funnel strips have bag wall film attached thereto. Then after separation of the strips and bag wall material assembly along the edge connection, the strips can be rolled-up for future use, or immediately used, by forming into individual bag sections to be filled, and the bag sections separated from the respective strips.

22 Claims, 5 Drawing Figures

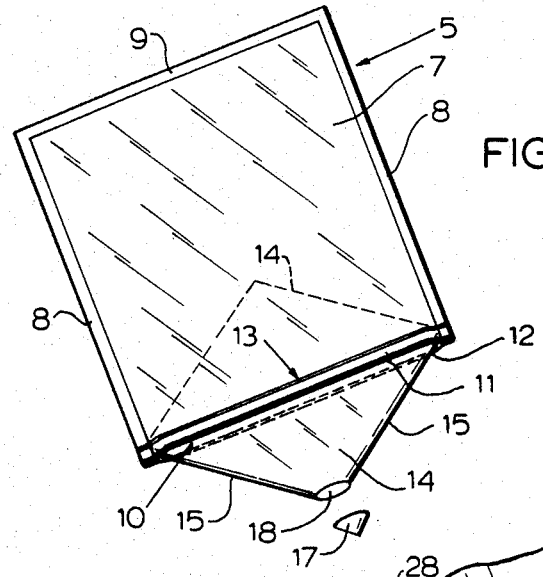
FIG. 1
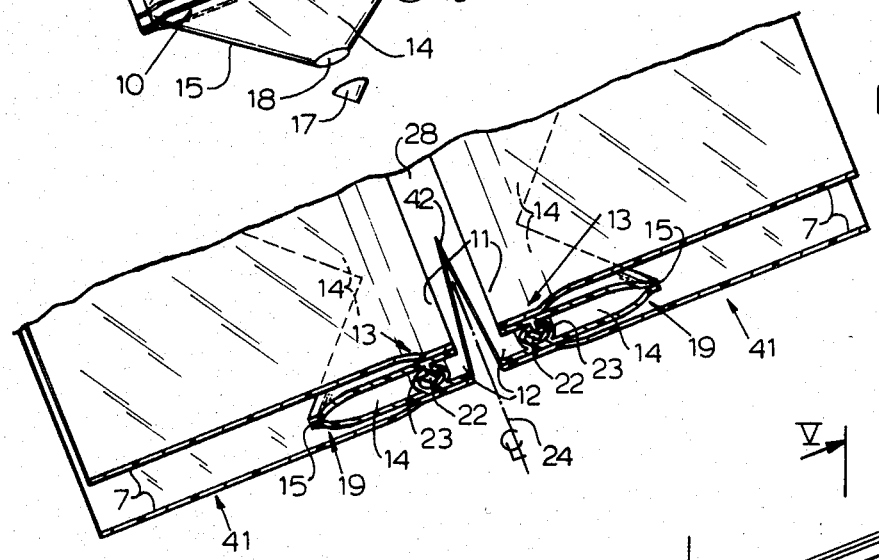
FIG. 3
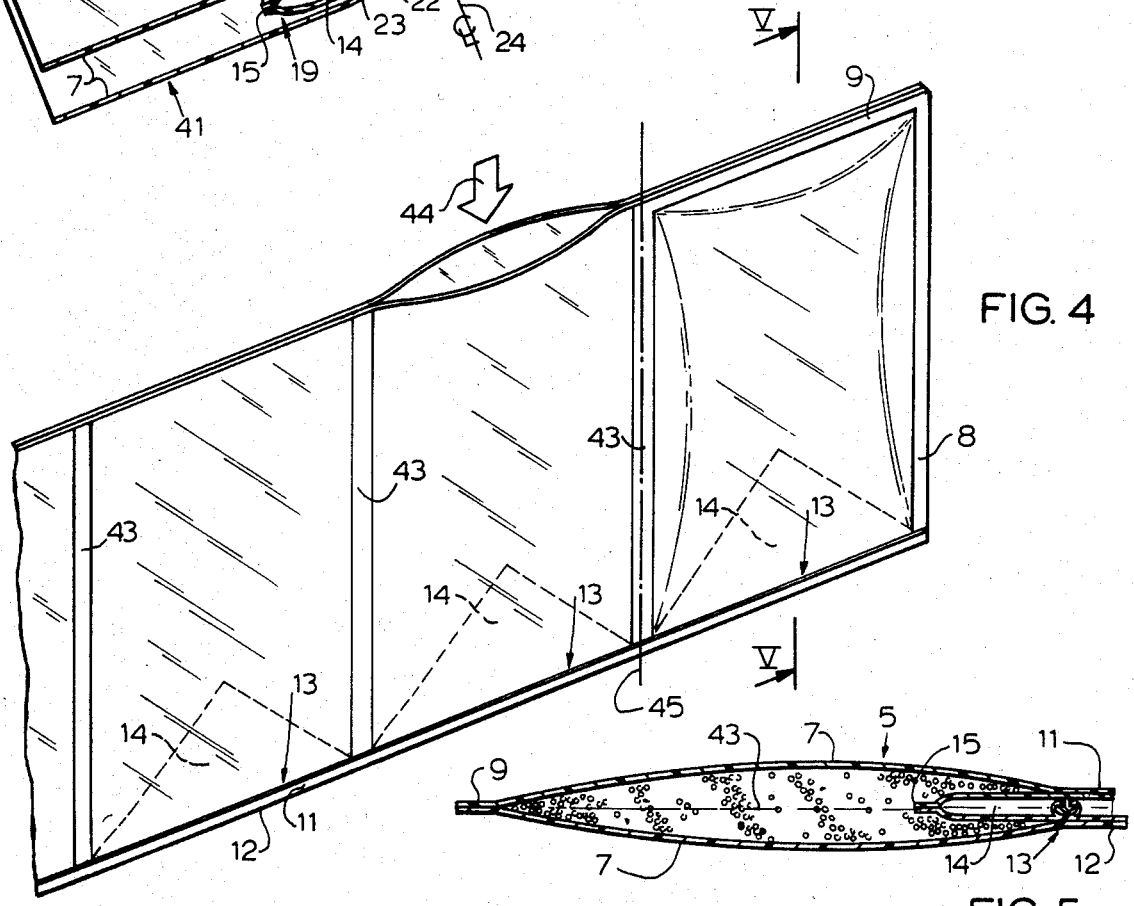
FIG. 4
FIG. 5

DOUBLE FUNNEL BAG MATERIAL AND METHOD

BACKGROUND OF THE INVENTION

This invention relates to improvements in bag construction, and is more particularily concerned with bags formed from extruded plastic material, sometimes referred to as plastic film, and especially suitable for reclosable bags which are adapted to be initially sealed, and which after being opened are reclosable, and especially such bags having funnel means to facilitate pouring discrete material contents from the bags.

Bags for pourable contents, whether liquid or particulate, and equipped with funnels are described in some detail in U.S. Pat. No. 4,196,030, which to any extent necessary is incorporated herein by reference. In that patent, the funnels are formed by doubling over sheet material, securing the free margins of the material to bag body sheet material, folding back the bag body material, and sealing the folded over funnel material along a zig-zag line and separating scrap material along that line so that when the joined bag body and funnel material is separated along transverse lines between the generally triangular funnel pockets into individual bags, the funnel pockets may be directed inwardly within the bags. When it is desired to pour a pourable contents from a bag, the funnel pocket is everted, that is turned inside out, and the tip of the funnel portion snipped off to permit pouring.

According to the disclosure of that patent a single line of funnel material is provided by extruding a tubular or flat funnel web and joining the funnel web to the inside of bag wall panels.

SUMMARY OF THE INVENTION

An important object of the present invention is to provide new and improved funnel material for bags, and method of making the same, which results in greatly increasing production, by at least a factor of two, that is by producing two funnel strips simultaneously, so that two lines of funnel-equipped bags are produced simultaneously.

Another object of the invention is to provide a new and improved construction of funnel bag material, wherein material for two complete sets of funnel equipped bags are simultaneously produced.

A further object of the invention is to provide new and improved funnel material for bags and method of making the same.

In a preferred embodiment of the invention, there is provided funnel material for bags, wherein connected funnel strips extend laterally away from one another, and have funnel pockets formed thereon, with contiguous longitudinal areas of the strips arranged to receive bag body material attached thereto so that by separating the two funnel portions and the attached bag body material, two ribbons of bag making material are produced and adapted for providing individual bag sections to be cross sealed, filled and divided into individual bag sections equipped with the funnel pockets. For access to the contents of the bags, the funnel pockets are adapted to be everted and the ends of the funnel pockets snipped off or otherwise separated for pouring from the funnels thus provided.

By equipping the bag material, and more particularily the funnel strips with separable fasteners, the separable fasteners provide means for reclosing the bags after each pouring interval after the funnels have been returned into the bags.

The described construction lends itself readily to a continuous mass production method.

BRIEF DESCRIPTION OF THE DRAWINGS

Other objects, features and advantages of the invention will be readily apparent from the following description of representative embodiments thereof, taken in conjunction with the accompanying drawings, although variations and modifications may be effected without departing from the spirit and scope of the novel concepts embodied in the disclosure, and in which:

FIG. 1 is a more or less schematic elevational view of a bag equipped with a funnel in accordance with the present invention.

FIG. 3 discloses separation of the funnel strips and bag body material assembly into bag making ribbons;

FIG. 4 shows how the bag making material ribbons are adapted to be filled and separated into individual bag sections, each of which has one of the funnel pockets incorporated therein, and FIG. 5 shows a longitudinal sectional detail view through a filled bag, taken substantially along the line V—V in FIG. 4.

DETAILED DESCRIPTION

Figure 2:
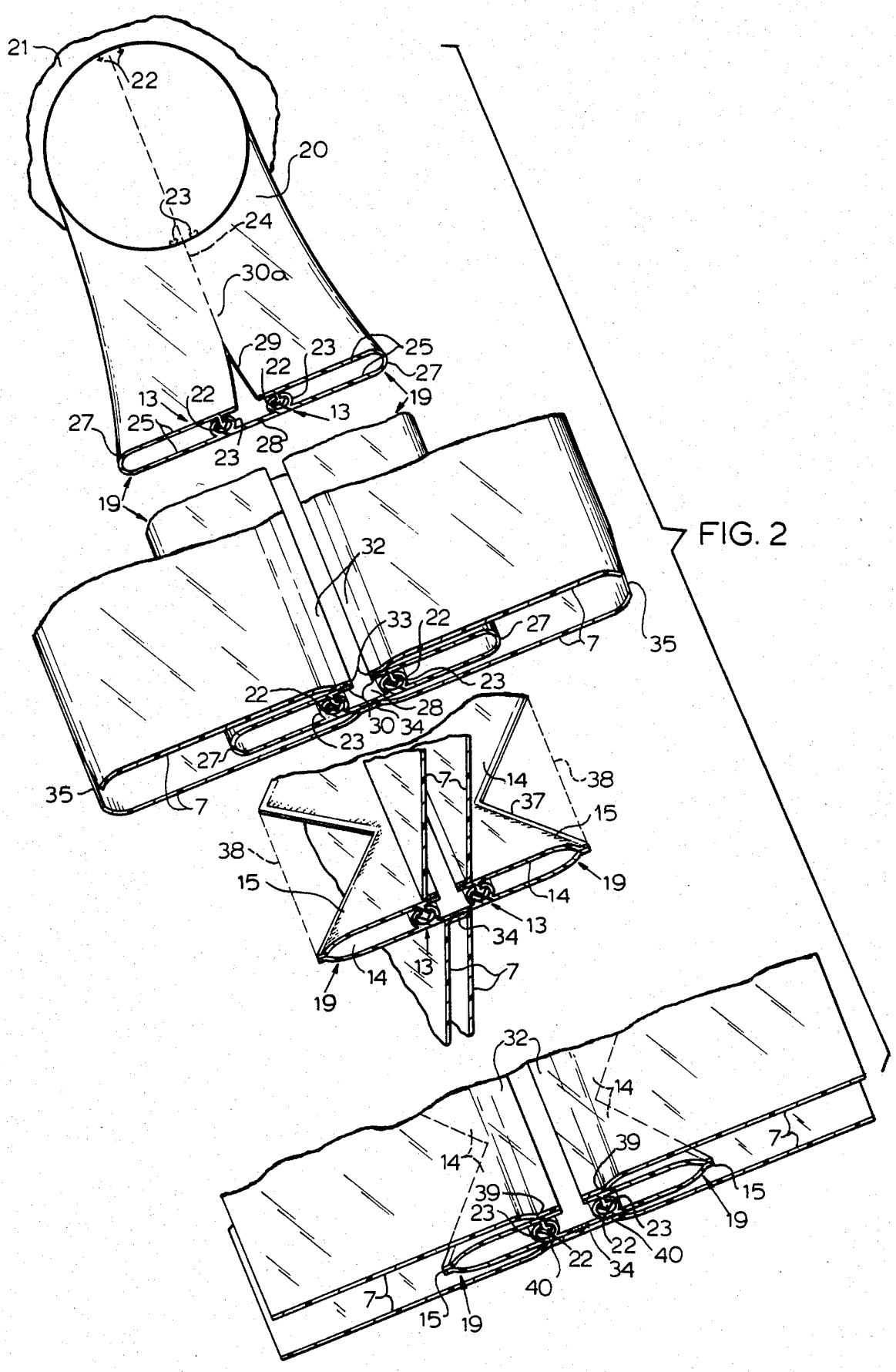
FIG. 2 is a schematic perspective view illustrating various steps in producing connected funnel strips for bags and incorporating bag body material with the funnel strips.

FIG. 1 shows for illustrative purposes, a bag 5 which may be made from the funnel equipped bag making material of the present invention. Such a bag has a body formed by means of wall panels 7 of suitable plastic material such as polyethylene, or the like, well-known in the art. Along each opposite side of the bag 5 the body panels 7 are sealed together as by heat seam seals 8. Along the bottom of the bag it is sealed by means of a heat seal seam 9. Along its normally upper end, the bag 5 has an access opening 10 defined between separating or pull flanges 11 and 12 which extend outwardly or upwardly relative to reclosable separable fastener means 13. Extending inwardly from the mouth 10 of the bag 5, and more particularily inwardly from the fastener means 13 is a funnel pocket 14 which may, as shown, be of generally triangular form. In the finished bag 5, the funnel pocket element 14 may be completely sealed where it is attached to the bag mouth ends of the bag wall panels 7 and also sealed along the inwardly converging edges, as shown at 15.

When it is desired to pour contents from the bag 5, the pull flanges 11 and 12 are pulled apart to separate the fastener means 13, and the funnel pocket 14 everted into the full line position shown in FIG. 1. Then, in order to make a pouring spout out of the funnel 14, a tip end 17 is snipped off to provide a pouring orifice 18. After as much of the contents as desired is poured out through the funnel 14, the bag is righted and the funnel reinserted into the bag and the fastener means 13 closed. This will avoid inadvertent spillage or entry of any undesirable object into the bag. In additon, by having the fastener 13 reasonably tight, a reasonably tight seal may be provided by the closed fastener means.

According to the present invention, a plurality, in this instance two, strips 19 (FIGS. 2 and 3) of funnel material are made simultaneously. A preferred method comprises forming an integral tubular extrusion 20 by means of an extrusion die 21 in any preferred well-known manner from the desired thermoplastic material. Although exaggerated for illustrative purposes, the extrusion 20 is desirably of as thin a film as practicable for the intended bag size and use. Integrally extruded with or at least integrally fused onto the inner surface of the tubular extrusion 20, are complementary sets of fastener profiles comprising, in each set, a first portion comprising a male profile rib 22 and a second portion comprising a grooved female profile 23. Although in the specific illustration a simple single arrow shaped male profile and a simple single groove shaped female profile has been shown, it will be understood that the cooperative rib and groove fastener profiles may be of any perferred other configurations such, for example, as the configuration disclosed in U.S. Pat. No. 3,948,705, wherein the cooperating profiles are in mirror image relation and comprise generally hook-shaped ribs fitting in complementary grooves of the companion profile structure.

The profiles 22 and 23 are so arranged that by collapsing the tubular extrusion 20 onto itself and bringing the profiles into registration, they will lie on either side of a longitudinal center line 24 of the extrusion 20, one of the profile sets 22, 23 lying on one side of the center line and the other set 22, 23 lying on the opposite side of the center-line and in properly spaced relation to one another for the intended purpose of providing each of the strips 19 with the fastener means 13.

In the collapsed condition, each of the strips 19 provides opposite, confronting walls 25 joined by a fold 27 and with at least one web 28 connecting one of the walls 25 of each of the strips 19, as for example between and connecting the spaced fastener profiles 23 of the fasteners 13. The opposite walls 25 may be separated from one another, as shown at 29, along the center line 24 and thereby provide respective flange extensions 30 along the free edges of the affected strip walls 25, and extending toward one another from the respective fastener profiles 22 of the fasteners 13. By having the total width of the flanges 30 as derived from a web **30*a* between the first profiles 22, less than the width of the web area 28, when the web area 28 is separated along the center line 24, the result will be respective flanges 31 which are wider than the opposite flanges 30 on each of the strips 19 for eventually conforming to the greater width of the pull flange 12 in the bag 5**.

In order to attain a proper relationship of the fastener profiles 22 and 23 for the arrangement wherein the terminal flanges or extensions of the strip walls 25 are of differential widths, the orientation of the profiles 22 and 23 on the extrusion 20 is desirably substantially proportionate to the differential width desired in the flanges 30 and 31. Accordingly, the profiles 22 which will be adjacent to the narrower flanges 30 are spaced apart so that the initial web area **30*a* therebetween will equal the total of the widths of the flanges 30. Thus, the profiles 22 on the extrusion 20 will be in a narrower spaced relation than the proportionately wider spaced relation of the profiles 23. Then, by effecting the split 29 and guiding the profiles 22 into matching, separably interlocked relation with the profiles 23, the desired spacing between the edges of the flanges 30** will be effected and maintained.

It will be appreciated, of course, that by having the flanges 30 and 31 of differential widths, the strips 19 will be accommodated to eventual differential width in the pull flanges 11 and 12 of the finished bags, represented by the bag 5 in FIG. 1.

If, instead of forming the extrusion 20 as a tubular extrusion, it is preferred to provide the material of the extrusion 20 as a flat sheet or film folded on itself from opposite sides, and with the fastener profiles 22 and 23 attached thereto either by integral extrusion or separate fabrication and fused attachment or adhesive attachment, according to known techniques, that may be the method employed. On the other hand, each of the strip walls 25 may be separately formed, as by means of extrusion or casting with the profiles 22 on one of the walls and the profiles 23 on the opposite wall. The interlocked profiles will maintain the two sheets in proper registration for subsequent working thereon.

Following the manufacturing steps already described, and in a continuous succeeding step, the bag wall material 7 may be joined to the strips 19. In one perferred arrangement, the bag wall material may be supplied as a continuous elongated sheet which is folded upon itself from opposite sides so that margins 32 of the bag wall sheet lap and are laminated to the flanges 30, as by means of fusion or welding 33. Attachment of the bag wall material 7 to the web 28 is desirably by means of fusion or welding 34. Following such attachment of the bag wall material to the funnel strips 19, the opposite folds in the bag wall material are desirably slit longitudinally as indicated at 35, and the bag walls 7 are folded toward one another along the opposite sides of the strips 19. The strips 19, as held in mutually stabilized relation by the connecting web area 28, are then secured by means of the seals 15 for zig-zag joinder and separated along lines 37 from scrap 38 to form the same into a series of the funnel pockets 14. Then the bag wall panels 7 are desirably returned to the original generally coplanar relation extending in opposite directons from the still connected edges of the strips 19.

Of course, if preferred, the bag wall panels 7 may be attached to the strips 19 in substantially the manner already described after the zig-zag joinders 15 and separation of scrap material along the lines 37 has been effected. However, the described manner of attachment of the bag wall panel material to the funnel strips has certain manufacturing facility advantages.

In some instances, for security of attachment of the components of the assembly, the marginal portions 32 of the bag wall material are desirably permanently secured by welding 33 not only to the flanges 30, but also to the base portions of the profiles 22 as by means of heat fusion or welding 39 or otherwise. This may be effected after the wall panels have been returned to the extended generally parallel relation. For the same purpose, the bag wall panel portions adjacent to the profiles 23 are desirably secured permanently, in addition to the welding 34, as by means of heat sealing or welding 40, or the like, to the bases of the profiles 23.

After the funnel pocket equipped bag making material has been completed as just described, it is desirably further processed as represented in FIG. 3. That is, the assembly is separated into respective bag material ribbons 41 by splitting the assembly along the center line 24, and as indicated at 42, medially longitudinally through the web 28 and the bag wall material attached thereto. Each of the ribbons 41 may then be immediately directed to a bag filling apparatus, or may be rolled up for storage and subsequent filling in a bag forming and filling apparatus line.

Separation into bags and filling of each of the bag making material ribbons 41, may be effected as demonstrated in FIG. 4. That is, the bag making ribbon may be advanced step-by-step, with the open bottom end portion of the ribbon extending upwardly. Successive bag width sections 5 of the ribbon are sealed across as indicated at 43. Each bag section is then filled with contents as indicated by the arrow 44. After filling, the bag bottom seals 9 are effected. Then the transverse seals 43 are separated, as indicated at 45, to release each filled bag section 5 from the ribbon. The bags 5 may then be handled as is customary.

As visualized in FIGS. 4 and 5, each of the pull flanges 11 and 12 will be of a double thickness laminated structure, which will facilitate grasping and pulling the same apart for separating the fastener 13 when it is desired to open the bag.

FIG. 5 shows how the filled bag contents may puff the bag walls 7 away from the funnel 14.

It will be understood that variations and modifications may be effected without departing from the spirit and scope of the novel concepts of the present invention.

I claim as my invention:

1. A method of making funnel strips for bags, comprising:

forming continuous length plastic film material into a plurality of coextensive funnel strips with confronting walls and having contiguous edges thereof connected together and thereby maintaining the strips in mutually stabilized relation;

providing each of the thus connected funnel strips along an edge thereof which is remote from the connected edges with a zig-zag edge defining a series of funnel pockets therealong; and separating the funnel strips, after said providing of said zig-zag edges, from one another along said contiguous edges.

2. A method according to claim 1, comprising providing said funnel strips with respective separably interlockable fastener elements adjacently spaced from said contiguous edges of the strips to leave pull flange areas between the fastener elements, and then separating the strips from one another along said contiguous edges and said areas and providing pull flanges extending from said fastener elements.

3. A method according to claim 2, which comprises providing a pull flange area web connecting said contiguous edges of said strips at one of said walls, slitting and separating contiguous edges along the other of said walls while the contiguous edges along said web remain connected, and after providing said zig-zag edges effecting said separating along the edges along said web.

4. A method according to claim 1, which comprises effecting said forming by extruding a tubular film, providing the inside of the film with complementary separable fastener means, collapsing the tubular film with the fastener means extending along the central portion of the collapsed tubular film, and with the fastener means for one of said strips along one side of a center line and the fastener means for the other of the strips along the other side of the center line, forming said zig-zag edges by heat sealing and removing scrap from between the funnel pockets, and then separating the funnel strips along said center line.

5. A method according to claim 4, which comprises maintaining said strips connected by means of connecting web means extending across said center line and between the fastener means of the strips until said zig-zag edges have been formed, and then separating the strips along said center line.

6. A method according to claim 1, which comprises equipping each of said funnel strips with separable fastener profiles along said contiguous edges and with pull flange areas intervening between said profiles and said contiguous edges, aligning bag wall material with said funnel strips and securing the bag wall material to the funnel strips along said pull flange areas, but free from the said walls in alignment with said fastener profiles, folding said bag wall material away from said remote edges and said profiles, providing said zig-zag edges, and then effecting said separating of the funnel strips from one another.

7. A method according to claim 1, which comprises forming said continuous length plastic film material as a tubular extrusion, providing adjacently spaced first separable fastener parts on the inside of said tubular extrusion and generally diametrically opposite thereto providing complementary second separably interlockable fastener parts for said strips on the inside of said tubular extrusion, connecting said first fastener parts in spaced relation by a web of predetermined width of said extrusion, connecting said second fastener parts in spaced relation to one another by a web of greater width of said extrusion, longitudinally splitting said web of predetermined width connecting said first parts, and collapsing said extrusion upon itself and aligning and interlocking said first fastener parts with said second fastener parts.

8. A method according to claim 7, which comprises laminating bag wall film material to said webs.

9. A method according to claim 8, which comprises also laminating said bag wall film material to the base portions of said first and second parts.

10. A method according to claim 8, which comprises separating the funnel strips by separating said web connecting said second parts and the bag wall material laminated thereto, for effecting said separating of the funnel strips from one another.

11. A method according to claim 1, comprising attaching in assembly with said funnel strips bag wall film material, sealing said assemblies into individual bag sections, filling the individual bag sections, and closing and separating the filled bag sections from one another.

12. Funnel strips for bags, comprising:

continuous length plastic film material having a plurality of coextensive funnel strips with confronting walls connected together along contiguous edges and thereby maintaining the strips in mutually stabilized relation;

each of said funnel strips as thus connected having along an edge which is remote from said contiguous edges a zig-zag formation defining a series of funnel pockets therealong; and said funnel strips being separable from one another along said contiguous edges to provide separate funnel strips.

13. Funnel strips according to claim 12, having respective separable interlockable fastener elements adjacently spaced from said contiguous edges, and pull flanges extending from said fastener elements.

14. Funnel strips according to claim 13, having at least one web connecting said contiguous edges between said fastener elements, and the strips being separable from one another along said web.

15. Funnel strips according to claim 12, wherein the strips are formed from a tubular film having complementary separable fastener means on the inside of the film, the tubular film being collapsed and the fastener means extending along the central portion of the collapsed tubular film, with the fastener means for one of the strips along one side of a center line and the fastener means for the other strips along the other side of the center line, said zig-zag edges being heat sealed, and the strips being separable along said center line.

16. Funnel strips according to claim 15, including connecting web means between the fastener means of the strips and maintaining the strips in coextensive relation until the zig-zag edges have been formed, the strips being separable along said web means.

17. Funnel strips according to claim 12, having separable fastener profiles along said contiguous edges, bag wall material being aligned with said strips and secured to the strips along said separable fastener profiles.

18. Funnel strips according to claim 12, wherein the strips are derived from continuous length plastic film material as a tubular extrusion, said tubular extrusion having adjacently spaced first separable fastener parts on the inside thereof, and generally diametrically opposite thereto complementary second separable fastener parts for said strips on the inside of said tubular extrusion, said first fastener parts being separably interlockable with said second fastener parts, said first fastener parts being connected in spaced relation by a web of predetermined width of said extrusion, said second fastener parts being connected in spaced relation to one another by a web of greater width of said extrusion, said web connecting said first parts being longitudinally split and the extrusion collapsed upon itself and said first parts being separably interlocked with said second parts.

19. Funnel strips according to claim 18, including bag wall film material laminated to said webs.

20. Funnel strips according to claim 19, wherein said bag wall film material is also laminated to the base portions of said first and second parts.

21. A method of making double funnel bag material, comprising:

extruding a continuous length tubular plastic film with two sets of diametrically opposite longitudinally extending sets of adjacently spaced interlockable fastener profile elements and with the profile elements of one set more closely spaced than the profile elements of the other set;

slitting the film along an intermediate line between said more closely spaced profile elements while leaving an attachment web of the film between the other set of profile elements intact;

collapsing the tubular film and joining the profiles of the one set with the complementary profiles of the other set, and thereby moving edges of the film along the slit into spaced relation while the film between said other set remains intact;

folding a bag wall sheet about said coextensive funnel strips and thereby providing bag body walls extending from each of said strips and connected by respective folds spaced from said strips;

securing edges of said bag body walls to said sets along said edges along said slit;

securing said sheet along an intermediate line to said web;

slitting said folds whereby to separate the bag wall material into separate bag wall panels overlying said strips;

folding said bag wall panels from opposite sides toward one another whereby to expose said strips;

providing each of the strips along an edge portion thereof which is remote from the fastener elements with a zig-zag edge defining a series of funnel pockets therealong;

removing the scrap from between the funnel pockets;

bending the wall panels back into overlying relation to the funnel strips; and separating the funnel strips and the attached bag wall panels from one another along a line extending along said attachment web.

22. Double funnel bag material, comprising:

a continuous length of one piece plastic film folded on itself and providing funnel strips each of which has opposed walls carrying a set of longitudinally extending interlockable fastener profiles;

one of the walls of each strip having a pull flange extending from the profile on this wall toward the other pull flange in spaced relation;

the other of said walls having an intact pull flange web connecting the profiles on the other walls of said strips;

a bag wall sheet folded about the connected funnel strips and thereby providing bag body walls extending from each of said strips;

edge portions of said bag body walls secured onto said pull flanges;

an intermediate length of said sheet secured to said web; and each of the funnel strips having a zig-zag edge which is remote from the fastener elements and defining a series of funnel pockets therealong.

* * * * *